United States Patent [19]

Shigemura et al.

[11] 4,456,673

[45] Jun. 26, 1984

[54] TRANSFER-TYPE ELECTROSTATIC COPYING METHOD

[75] Inventors: Yutaka Shigemura, Takarazuka; Masahiko Hisajima, Osaka; Hiroshi Kimura, Habikino; Isao Yada, Neyagawa; Yoichiro Irie, Suita; Kiyoshi Morimoto, Osaka; Takashi Nagashima, Neyagawa, all of Japan

[73] Assignee: Mita Industrial Co., Ltd., Japan

[21] Appl. No.: 356,538

[22] Filed: Mar. 9, 1982

[30] Foreign Application Priority Data

Mar. 24, 1981 [JP] Japan ..... 56/41795

[51] Int. Cl.[3] ..... G03G 13/22

[52] U.S. Cl. ..... 430/125; 355/8; 355/14 R

[58] Field of Search ..... 430/125; 118/637; 117/125; 355/3, 14, 8

[56] References Cited

U.S. PATENT DOCUMENTS

| | | | |
|---|---|---|---|
| 3,637,306 | 1/1972 | Cooper | 355/15 |
| 3,923,004 | 12/1975 | Eichorn | 430/125 |
| 4,095,980 | 6/1978 | Satomi | 430/125 |

OTHER PUBLICATIONS

Photographic Science & Engineering, vol. 26, #4, 1982.

*Primary Examiner*—John E. Kittle
*Assistant Examiner*—J. Goodrow
*Attorney, Agent, or Firm*—Beveridge, DeGrandi & Kline

[57] ABSTRACT

An electrostatic copying method of the transfer type which comprises repeatedly performing a copying cycle including an image-forming step of forming a latent electrostatic image on a photosensitive material moved through an endless moving path or a toner image obtained by developing it, a transfer step of transferring the latent electrostatic image or the toner image on the photosensitive material to a receptor member subsequent to the image-forming step, and a cleaning step of cleaning the photosensitive material subsequent to the transfer step. When the width or length of a receptor member to be used in the next copying cycle is found to be larger than the width or length of a receptor member used in the preceding copying cycle as a result of comparison of at least one of the width and length of the receptor member to be used in the next copying cycle respectively with at least one of the width and length of the receptor member used in the preceding copying cycle, the above cleaning step is additionally performed after the end of the preceding copying cycle before the next copying cycle is started.

3 Claims, 2 Drawing Figures

TRANSFER-TYPE ELECTROSTATIC COPYING METHOD

FIELD OF THE INVENTION

This invention relates to a transfer-type electrostatic copying method, and more specifically, to a transfer-type electrostatic copying method which comprises repeatedly performing a copying cycle including a transfer step of transferring a latent electrostatic image or a toner image formed on a photosensitive material to the surface of a receptor member.

DESCRIPTION OF THE PRIOR ART

It is well know in the art that in recent years, the "direct-type" electrostatic copying method which performs a copying cycle comprising forming a latent electrostatic image on a photosensitive sheet having photosensitive properties by itself and then developing the latent electrostatic image to a toner image has been widely superseded by an electrostatic copying method adapted for the transfer of a latent electrostatic image or a toner image which comprises performing a copying cycle including an image-forming step of forming a latent electrostatic image on a suitable photosensitive material or a toner image obtained by developing the latent electrostatic image, a subsequent transfer step of transferring the latent electrostatic image or the toner image formed on the photosensitive material to a suitable receptor member such as plain paper, and a subsequent cleaning step of cleaning the photosensitive material for the next copying cycle. In the latent electrostatic image-transferring type method, by which the latent electrostatic image formed on the photosensitive material is transferred to the receptor member without development, and the latent electrostatic image so transferred is then developed to a toner image.

The conventional electrostatic copying method adapted for the transfer of a latent electrostatic image or a toner image presents the following problems in repeatedly performing the copying cycle comprising the image-forming step, the transfer step and the cleaning step. It frequently happens in the aforesaid copying cycle that the size of the latent electrostatic image or the toner image formed on the photosensitive material does not correspond with that of the receptor member to which the latent electrostatic image or the toner image has been transferred. For example, when only a part of an original document having a relatively large size is to be copied, a latent electrostatic image or a toner image of a relatively large size is formed on the photosensitive material, whereas in most cases a receptor member of a relatively small size is used. Furthermore, even when the size of an original document is substantially the same as that of a receptor member used, a latent electrostatic image or toner image corresponding to the original document might often exceed the receptor member in size. For example, when the original document is a particular page of a book, the surrounding portion of the book cannot be sufficiently isolated optically by an original-holding device because of the thickness of the book, and consequently, the resulting latent electrostatic image or toner image on the photosensitive material consists of an image; corresponding to the particular page of the book and a gray region surrounding it.

It has already been suggested, on the other hand, to control the aforesaid image-forming step according to the length of a receptor member used. If this controlling method is used, the length of the latent electrostatic image or toner image formed on the photosensitive material can be made substantially equal to that of the receptor member irrespective of the type of the original document. It is extremely difficult, if not impossible, however, to control the image-forming step according to the width of the receptor member used and thus to make the width of the latent electrostatic image or toner image formed on the photosensitive material substantially equal to the width of the receptor member used. Thus, generally, a latent electrostatic image or a toner image formed on a photosensitive material necessarily has a larger size (particularly, a larger width) than that (particularly, the width) of a receptor member used.

It will be readily seen that when the size of the latent electrostatic image or the toner image formed on the photosensitive material is larger than that of the receptor member used, the latent electrostatic image or the toner image on the photosensitive material is partly transferred to the receptor member in the subsequent transfer step, but that part of the latent electrostatic image or toner image which is located outside the receptor member will remain on the photosensitive material without being transferred to the receptor member. In that area of the photosensitive material from which the latent electrostatic image or the toner image has been transferred to the receptor member, one cleaning step subsequently performed can well remove the static charge (when the image on the photosensitive material is a latent electrostatic image) or both the static charge and the toner particles (when) the image on the photosensitive material is a toner image) remaining on that area of the photosensitive material. But in that area of the photosensitive material on which the latent electrostatic image or the toner image remains untransferred, one cleaning step cannot fully remove the static charge or both the static charge and the toner particles remaining on that part of the photosensitive material. Particularly, when a toner image is formed on the photosensitive material, a considerably large amount of toner particles remain on that part of the photosensitive material on which the toner image remains untransferred to the receptor member. Since the large amount of toner particles obstruct transmission of the light of a charge-eliminating lamp or the flow of a current from a charge-eliminating discharge device, there is an increasing tendency toward insufficient cleaning.

This insufficient cleaning, however, does not present any particular problem if the size of a receptor member used in the next copying cycle is substantially equal to, or smaller than, that of the receptor member used in the preceding copying cycle. In this situation, the electrostatic latent image or the toner image formed in the next copying cycle in that area of the photosensitive material in which insufficient cleaning did not occur in the preceding copying cycle can be transferred to the receptor member. However, if the size of a receptor member to be used in the next copying cycle is larger than that of the receptor member used in the preceding copying cycle, an electrostatic latent image or a toner image is partly formed in the aforesaid area where cleaning was insufficient in the preceding cycle, and therefore, the latent electrostatic image or the toner image partly having poor image quality is transferred to the receptor member and the resulting copy partly has poor image quality.

SUMMARY OF THE INVENTION

It is an object of this invention therefore to provide an improved transfer-type electrostatic copying method by which even when the size of a receptor member to be used in the next copying cycle is larger than that of a receptor member used in the preceding copying cycle, a copy having good image quality throughout can be surely obtained in the next copying cycle.

Extensive investigations made by the present inventors have led to the discovery that by comparing the size (at least one of the width and length) of a receptor member to be used in the next copying cycle with that (at least one of the width and length) of a receptor member used in the preceding copying cycle, and if the size of the receptor member to be used in the next copying cycle is found to be larger and therefore the aforesaid insufficient cleaning is likely to degrade the quality of the image in a part of the resulting copy, additionally performing a step of cleaning the photosensitive material after the end of the preceding copying cycle but before the start of the next copying cycle thereby completely solving the problem of insufficient cleaning, the formation of a copy having good image quality throughout can be insured in the next copying cycle.

Thus, according to this invention, there is provided an electrostatic copying method of the transfer type which comprises repeatedly performing a copying cycle including an image-forming step of forming a latent electrostatic image on a photosensitive material moved through an endless moving path or a toner image obtained by developing the latent electrostatic image, a transfer step of transferring the latent electrostatic image or the toner image on the photosensitive material to a receptor member subsequent to the image-forming step, and a cleaning step of cleaning the photosensitive material subsequent to the transfer step; characterized in that said method further comprises comparing at least one of the width and length of a receptor member to be used in the next copying cycle respectively with at least one of the width and length of a receptor member used in the preceding cycle, and when the width or length of the receptor member to be used in the next copying cycle is found to be larger than the width or length of the receptor member used in the preceding copying cycle, additionally performing said cleaning step after the end of the preceding copying cycle before the next copying cycle is started.

DETAILED DESCRIPTION OF THE PREFERRED EMBODIMENTS

With reference to the accompanying drawings, one specific embodiment of the transfer-type electrostatic copying method in accordance with this invention is described below in greater detail.

Figure 1:
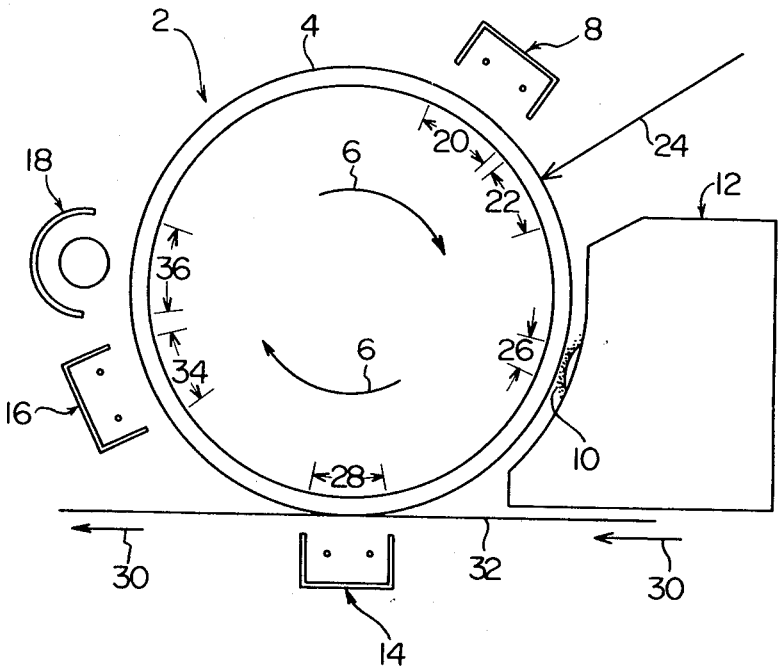
FIG. 1 is a diagrammatic simplified view of one example of a copying machine for use in practicing one embodiment of the transfer-type electrostatic copying method of this invention.

FIG. 1 diagrammatically shows one example of a copying apparatus used for practicing one specific embodiment of the transfer-type electrostatic copying method in accordance with this invention. In the copying apparatus shown in FIG. 1, a rotary drum 2 is rotatably provided, and a photosensitive material 4 is disposed in at least a part of the peripheral surface of the rotary drum 2. The rotary drum 2 is rotated in the direction shown by an arrow 6, and by the rotation of the rotary drum 2, the photosensitive material 4 is moved through a circular endless moving path defined by the peripheral surface of the rotary drum 2. Around the rotary drum 2 are disposed a charging corona discharge device 8, a developing and eliminating device 12 having a magnetic brush mechanism 10, a transferring corona discharge device 14, a charge-eliminating corona discharge device 16 and a charge-eliminating lamp 18 successively in this order viewed in the rotating direction of the rotary drum 2 indicated by the arrow 6.

In the copying apparatus described above, the copying cycle is performed in the following manner according to the rotation of the rotary drum 2 in the direction of arrow 6. First, a corona discharge is applied to the photosensitive material 4 by the action of the charging corona discharge device 8 in an area shown by 20. Then, in an area shown by 22, the image of an original document (not shown) to be copied is projected onto the photosensitive material 4 as shown by an arrow 24 by the action of an optical unit (not shown), whereupon a latent electrostatic image corresponding to the image of the original document is formed on the photosensitive material 4. Subsequently, in an area shown by 26, the magnetic brush mechanism 10 of the developing and eliminating device 12 acts on the photosensitive material 4 to apply toner particles to the latent electrostatic image whereby the latent electrostatic image is developed to a toner image (at this time, the developing and eliminating device 12 functions as a developing device). In the illustrated copying apparatus, therefore, an image-forming step is performed which comprises forming a latent electrostatic image on the photosensitive material 4 in the areas 20, 22 and 26 and applying toner particles to the latent electrostatic image to develop it to a toner image.

Subsequent to the image-forming step, a transfer step is carried out in an area shown by 28. Specifically, in the area 28, a receptor member 32 such as plain paper delivered from a suitable receptor member feeding mechanism (not shown) and conveyed in the direction shown by an arrow 30 is brought into intimate contact with the surface of the photosensitive material 4, and simultaneously, a corona discharge is applied to the back of the receptor member 32 by the action of the transferring corona discharge device 14. As a result, the toner image on the photosensitive material 4 is transferred to the receptor member 32.

The receptor member 32 having the toner image transferred thereto is separated from the surface of the photosensitive material 4 and further conveyed in the direction shown by the arrow 30. After the transferred toner image is fixed by the fixing action of a fixing device (not shown), it is discharged as a copy out of the copying apparatus.

In the meantime, the rotary drum 2 continues to rotate. A corona discharge is applied to the photosensitive material 4 by the action of the charge-eliminating corona discharge device 16 in an area shown by 34, and then the photosensitive material 4 is irradiated by the charge-eliminating lamp 18 in an area shown by 36. As a result, the static charge remaining on the photosensitive material 4 after the transfer step is eliminated. After the charge elimination, the rotary drum 2 further keeps rotating and begins its second rotation. During the second rotation, the magnetic brush mechanism 10 of the developing and eliminating device 12 acts on the photosensitive material 4 in the area 26. The toner particles remaining on the photosensitive material 4 after the transfer step are attracted to the magnetic brush mechanism 10 and thus eliminated (therefore, the developing and eliminating device 12 acts as an eliminating device at this time). Accordingly, in the illustrated copying apparatus, a cleaning step of removing the residual charge and the residual toner particles from the photosensitive material 4 after the transfer step is performed in the areas 34, 36 and 26. Of course, when the rotary drum 2 rotates for the second turn and the residual toner particles are removed in the area 26, formation of a latent electrostatic image is not effected in the areas 20 and 22. Hence, at this time, the charging corona discharge device 8 and the optical unit (not shown) are out of operation, and the transferring corona discharge device 14, too, is set out of operation as soon as the transfer of the toner image from the photosensitive material 4 to the receptor member 32 is over.

The copying cycle to be performed in the illustrated copying machine consisting of the image-forming step, the transfer step and the cleaning step is the same as that in a conventional transfer-type electrostatic copying method. In the conventional transfer-type electrostatic copying method, the above copying cycle is simply repeated. Accordingly, when the size of a toner image formed on the photosensitive material 4 is larger than the size of the receptor member 32 and even after the transfer step in the area 28, a part of the toner image on the photosensitive material 4 remains untransferred to the receptor member 32, insufficient cleaning occurs partly on the photosensitive material 4. Thus, if the size of a receptor member 32 to be used in the next copying cycle is larger than that of the receptor member 32 used in the preceding copying cycle, a copy obtained in the next copying cycle partly has poor image quality.

In order to solve the above problem with the conventional transfer-type electrostatic copying method, the transfer-type electrostatic copying method in accordance with this invention further involves comparing the size of the receptor member 32 to be used in the next copying cycle with that of the receptor member 32 used in the preceding copying cycle, and when the size of the receptor member 32 to be used in the next cycle is found to be larger than that of the receptor member 32 used in the preceding copying cycle, performing an additional cleaning step. Specifically, the rotary drum 2 is further rotated and the residual static charge is removed in the areas 34 and 36 and the residual toner particles are removed in the area 26.

This additional cleaning step will now be described in more detail with reference to FIG. 2 which is a flow chart of the transfer-type electrostatic copying method of this invention performed by the copying apparatus shown in FIG. 1.

In the copying apparatus illustrated in FIG. 1, the copying cycle is started by manually closing a start switch (not shown). When the start switch is closed by manual operation, the rotary drum 2 sets in rotation. On the basis of the rotation of the rotary drum 2, the operations of various constituent elements such as the charging corona discharge device 8, the developing and eliminating device 12, the transferring corona discharge device 14, the charge-eliminating corona discharge device 16, the charge-eliminating lamp 18, the optical unit (not shown) and the receptor member feeding mechanism (not shown) are properly controlled, and the aforesaid copying cycle consisting of the image-forming step, the transfer step and the cleaning step is performed. When one copying cycle is over, the size of the receptor member 32 used in this cycle is compared with the size of a receptor member 32 to be used in the next copying cycle.

It is preferred to compare both the widths and lengths of the receptor members 32 and to judge that in any of the following instances, the size of the receptor member 32 to be used in the next copying cycle is larger than that of the receptor member 32 used in the preceding copying cycle.

(i) When both the width and length of the receptor member 32 to be used in the next copying cycle are larger than the width and length of the receptor member 32 used in the preceding copying cycle.

(ii) When only the width of the receptor member 32 to be used in the next copying cycle is larger than the width of the receptor member 32 used in the preceding copying cycle.

(iii) When only the length of the receptor member 32 to be used in the next copying cycle is larger than the length of the receptor member 32 used in the preceding copying cycle.

However, when, for example, the receptor member 32 fed from the receptor member feeding mechanism (not shown) has a variable width but a constant length, or when the image-forming step in the copying cycle is controlled according to the length of the receptor member 32 actually fed from the receptor member feeding mechanism to make the length of a toner image formed on the photosensitive material 4 substantially equal to that of the receptor member 32 to which the toner image is to be transferred, it is possible to compare only the widths of the receptor members 32 and judge that only in the instance (ii) above, the size of the receptor member 32 to be used in the next copying cycle is larger than that of the receptor member 32 used in the preceding copying cycle. Moreover, when, for example, the receptor member 32 fed from the receptor member feeding mechanism (not shown) has a variable length but a constant width, it is possible to compare only the lengths of the receptor members 32 and to judge that only in the instance (iii), the size of the receptor member 32 to be used in the next copying cycle is larger than that of the receptor member 32 used in the preceding copying cycle.

When the receptor member feeding mechanism (not shown) is of the type adapted to feed a receptor sheet of a specified size properly selected from receptor sheets of various sizes loaded in the copying machine, the comparison and judgement of the sizes of the receptor members 32 can be effected by detecting changes in the condition of, for example, a change-over switch to be manually operated for the selection of the receptor sheet of the specified size. When the receptor member feeding mechanism (not shown) is of the type adapted to feed a receptor member unwound from a roll and cut to a suitable length, the comparison and judgement of the sizes can be performed by detecting the size of a receptor sheet actually supplied.

When as a result of the comparison of the sizes of the receptor members 32, the size of the receptor member 32 to be used in the next copying cycle is equal to, or smaller than, the size of the receptor member 32 used in the preceding copying cycle, the next thing to do is to judge whether the copying cycle has been repeated the required number of times prescribed, for example, by the operator (that is, whether the required number of copies have been formed). When the copying cycle has been repeatedly carried out the required number of times, an output is generated to stop the operation of the copying apparatus and to show that as required, the next cycle of copying can be started, namely preparations for the next cycle of copying have been completed. When this output is generated, the operator can start the next cycle of copying by manually operating the start switch (not shown). On the other hand, when the copying cycle has not been repeated the required number of times, the copying cycle is repeated after the end of the preceding cycle.

On the other hand, when the comparison of the sizes of the receptor members 32 shows that the size of the receptor member 32 to be used in the next copying cycle is larger than the size of the receptor member 32 used in the preceding copying cycle, the usual operating procedure of the copying apparatus is terminated and the additional cleaning step is performed, irrespective of whether the copying cycle has been repeated the required number of times. Specifically, the rotary drum 2 is further rotated to remove the residual static charge in the areas 34 and 36 and the residual toner particles in the area 26. If required, the additional cleaning step can be performed two or more times. When the additional cleaning step has ended, an output is generated to stop the operation of the copying apparatus and show that the aforesaid preparations for the start of the next copying cycle have been completed. Thus, the operator can start the next cycle of copying operation by manually operating the start switch (not shown). If the copying cycle has not been repeated the required number of times, it is possible, if desired, to start the next copying cycle instead of stopping the operation of the copying apparatus subsequent to the end of the additional cleaning step.

Figure 2:
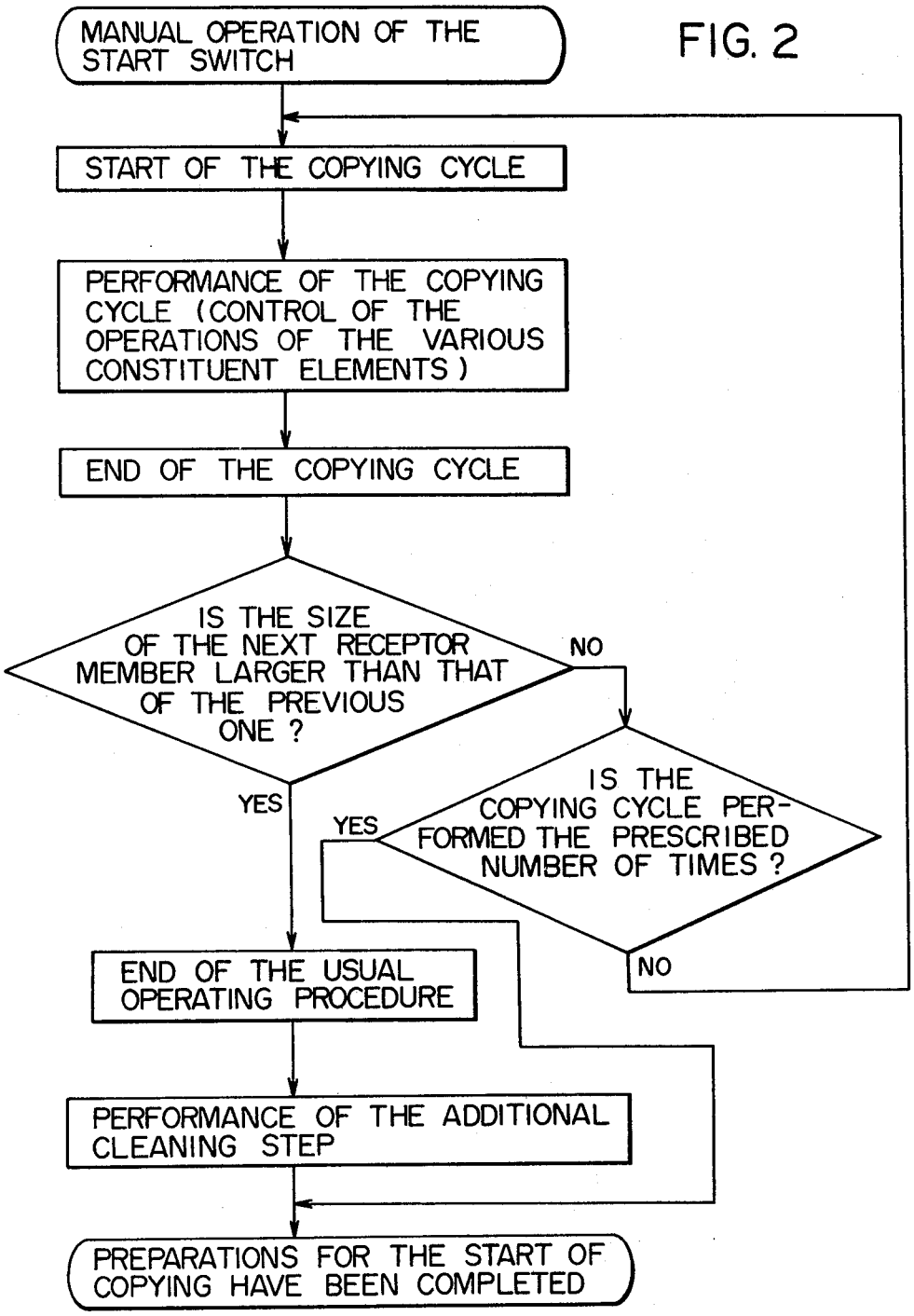
FIG. 2 is a flow chart showing one embodiment of the transfer-type electrostatic copying method of this invention.

In order to perform the procedure shown in FIG. 2 automatically in the copying apparatus shown in FIG. 1, the operation of the copying apparatus may be properly controlled by providing the copying apparatus with a suitable control circuit which can be constructed by properly combining logical circuits, or with a microcomputer, for example.

According to the transfer-type electrostatic copying method in accordance with this invention, when the size of the receptor member 32 to be used in the next copying cycle is found to be larger than that of the receptor member 32 used in the preceding copying cycle, the cleaning step is additionally performed independently from the normal copying cycle after the end of the preceding copying cycle but before the start of the next copying cycle, Hence, even when the size of the toner image formed on the photosensitive material 4 in the preceding copying cycle is larger than the size of the receptor member 32 used and owing to this, there is formed on the photosensitive material 4 an area which has been only insufficiently cleaned by the cleaning step in the preceding copying cycle, the additional cleaning step to be performed after the end of the preceding copying cycle but before the start of the next copying cycle performs good cleaning of the above insufficiently cleaned area. Accordingly, a degradation in the quality of the image in a part of a copy obtained in the next copying cycle can be surely avoided.

Although one specific embodiment of the transfer-type electrostatic copying method of this invention has been described in detail hereinabove with reference to the accompanying drawings, it is to be understood that the present invention is not limited to this specific embodiment and various changes and modifications are possible without departing from the scope of the present invention.

For example, the method of this invention has been described hereinabove with regard to a toner image-transferring type method adapted to form a latent electrostatic image on the photosensitive material 4, apply toner particles to the latent electrostatic image to develop it to a toner image, and transfer the toner image on the photosensitive material 4 to the receptor member 32, the present invention can be applied also to a latent electrostatic image-transferring type electrostatic copying method which comprises transferring the latent electrostatic image formed on the photosensitive material 4 directly to the receptor member 32 without prior development to a toner image.

Furthermore, the copying apparatus shown in FIG. 1 is merely one form of copying machine on which the transfer-type electrostatic copying method of this invention can be practiced. The electrostatic copying method of this invention can be performed on various forms of electrostatic copying machines of the transfer type.

What we claim is:

1. In an electrostatic copying method of the transfer type which comprises repeatedly performing a copying cycle including an image-forming step of forming a latent electrostatic image on a photosensitive material moved through an endless moving path or a toner image obtained by developing the latent electrostatic image, a transfer step of transferring the latent electrostatic image or the toner image on the photosensitive material to a receptor member subsequent to the image-forming step, and a cleaning step of cleaning the photosensitive material subsequent to the transfer step; the improvement which comprises determining the width and length of the receptor member to be used in the next copying cycle, automatically comparing at least one of the width and length of the receptor member to be used in the next copying cycle with at least one of the width and length respectively of the receptor member used in the preceding copying cycle, and only when at least one of the width or length of the receptor member to be used in the next copying cycle is found to be larger than at least one of the width or length respectively of the receptor member used in the preceding copying cycle, repeating said cleaning step after the end of the preceding copying cycle and before the next copying cycle is started.

2. The improvement of claim 1 comprising comparing both the width and length of the receptor member to be used in the next copying cycle with the width and length respectively of the receptor member used in the preceding copying cycle, and when the width or length or both of the receptor member to be used in the next copying cycle are found to be larger than the width or length respectively or both of the receptor member used in the preceding copying cycle, repeating the cleaning step.

3. The improvement of claim 1 or 2 wherein the image-forming step comprises forming a latent electrostatic image on the photosensitive material and then applying toner particles to the latent electrostatic image to develop the latent electrostatic image to a toner image, and the cleaning step comprises eliminating the static charge remaining on the photosensitive material after the transfer step and eliminating toner particles remaining on the photosensitive material after the transfer step.

* * * * *